US005717369A

United States Patent [19]

Wilson

[11] Patent Number: 5,717,369

[45] Date of Patent: Feb. 10, 1998

[54] ALTERNATING CURRENT RELAY

[76] Inventor: Arthur L. Wilson, P.O. Box 117, 510 Main St., Delta, Pa. 17314

[21] Appl. No.: 643,009

[22] Filed: May 3, 1996

[51] Int. Cl.[6] ..... H01H 67/02

[52] U.S. Cl. ..... 335/128; 335/80; 335/153

[58] Field of Search ..... 335/78–86, 124, 335/128, 131, 153

[56] References Cited

U.S. PATENT DOCUMENTS

| | | | |
|---|---|---|---|
| 1,031,387 | 7/1912 | Smith et al. . | |
| 1,753,726 | 4/1930 | Sosinski . | |
| 2,160,056 | 5/1939 | Brandt . | |
| 2,297,339 | 9/1942 | Wilms et al. . | |
| 2,484,934 | 10/1949 | Debrey . | |
| 2,833,883 | 5/1958 | Auten . | |
| 3,032,627 | 5/1962 | Ronk . | |
| 3,735,301 | 5/1973 | Lang . | |
| 3,824,508 | 7/1974 | Terracol . | |
| 4,609,897 | 9/1986 | DeKoster et al. . | |
| 4,633,209 | 12/1986 | Belbel et al. . | |
| 5,053,756 | 10/1991 | Wehrle et al. | 335/274 |
| 5,122,770 | 6/1992 | Held | 335/277 |
| 5,359,307 | 10/1994 | Mahoney et al. | 335/128 |

FOREIGN PATENT DOCUMENTS

| | | |
|---|---|---|
| 1051651 | 9/1953 | France . |
| 2253514 | 4/1974 | Germany . |

*Primary Examiner*—Lincoln Donovan

*Attorney, Agent, or Firm*—Sixbey, Friedman, Leedom & Ferguson; Charles M. Leedom, Jr.; Bradley D. Blanche

[57] ABSTRACT

An alternating current relay including a wire coil having the wire wrapped in the same direction to form a wire coil having substantially parallel windings with the wire coil also being connectable to an alternating current source. The wire coil includes a central passage extending in a direction substantially perpendicular to the direction of the wire windings, wherein a cylindrical core extends through the central passage of the wire coil and further extends through the top surface of the coil in the longitudinal direction of the central passage. A non-magnetic, annular armature is positioned a predetermined distance from the top surface of the wire coil, with the armature being positioned substantially parallel to the windings of the wire coil. The cylindrical core further extends through the center of the armature, and the armature is movable in response to a magnetic force generated by the wire coil, wherein the armature may reciprocate along the longitudinal axis of the cylindrical core. The A.C. relay further includes a movable contact board connected to the armature, wherein the movable contact board is positioned between two other contact boards. Each contact board includes a plurality of contacts mounted thereon which are connected to external circuits, wherein the contacts on the movable contact board are switched between the contacts on the two other contact boards in response to the movement of the armature.

30 Claims, 5 Drawing Sheets

ALTERNATING CURRENT RELAY

BACKGROUND OF THE INVENTION

1. Technical Field

The present invention relates to an electrical relay device and, in particular, an alternating current relay to be used for the reliable simultaneous switching of a plurality of electrical contacts.

2. Background Art

Power relays have evolved over many years within a common body of art, and are available from many sources in relatively standardized forms. Structures, mountings, terminals, contact arrangements, solenoid designs and other principal elements are similar. The functional parameters including contact current rating, response time, solenoid input wattage, temperature rise and service life are quite uniform for a given load rating. Switching contacts have been found to require substantial mechanical forces thus requiring actuating solenoids of relatively high power. It is common practice to provide from 8.0 to 16.0 ounces of solenoid tractive force per switch per pole used in load circuits involving 20 to 30 amperes at 200 to 500 volts.

Prior art solenoids for the present use almost invariably utilize laminated magnetic cores, provided with copper shading rings to attain phase-splitting necessary to overcome the weak tractive forces and objectionable buzz which is otherwise characteristic of single phase electromagnets. Shading-ring solenoids operate at low values of efficiency therefor requiring relatively high values of input power, per unit of tractive force attained. It is well known that D.C. solenoids yield as much as 10 ounces of tractive force per watt of input, whereas A.C. shading-ring solenoids produce only 3.0 to 4.0 ounces per watt. Thus for a given force requirement a relatively high wattage must be dissipated by the solenoid, therefor requiring relatively large solenoid assemblies having large numbers of cosily copper windings in the magnet coil. High input wattage and the associated rapid and detrimental temperature rise have been commonly accepted as unavoidable incidence of A.C. relay constructions heretofore available.

Past efforts to overcome the above limitations have included careful attention to design details of A.C. solenoids, as well as resort to D.C. solenoids supplied from auxiliary power supplies, or energized by A.C. applied through full-wave diode bridge rectifiers. Preamplification is also sometimes applied, but is subject to high cost, reliability, and power supply objections. Efforts to reduce solenoid wattage requirements by reducing relay spring forces and contact pressures have generally resulted only in decreased reliability and contract life expectancy, slower response time, and increased susceptibility to malfunction due to mechanical shock loads or vibration.

The present invention is directed to a solenoid operated relay. In such a relay, electrical contacts are mechanically actuated by a solenoid. Such a construction is particularly desirable when multiple switching contacts are employed. In such circumstances it is important that the various contacts make and break in synchronism. It has been recognized that this result is difficult to attain when using relays.

The present solution to the long existing problems discussed above is to provide a relay actuator operated by A.C. which makes and breaks a plurality of contacts in synchronism, which provides an improved design of an A.C. solenoid for more efficiently controlling the switching of multiple contacts, which does not require the use of laminated magnetic core or magnetic armature, and which is producible at costs lower than prior art shading ring solenoids.

SUMMARY OF THE INVENTION

It is a primary object of the present invention to overcome the aforementioned shortcomings associated with the prior art.

Another object of the present invention is to provide an A.C. relay which does not require the use of a laminated magnetic core.

Yet another object of the present invention is to provide an A.C. relay utilizing a configuration which improves the efficiency of the A.C. relay.

It is yet another object of the present invention to provide an A.C. relay which does not require an armature comprised of a magnetic material.

It is a further object of the present invention to provide a reliable A.C. relay for the simultaneous switching of a plurality of electrical contacts.

These as well as additional objects and advantages of the present invention are achieved by provided an A.C. relay including a tubular base unit having a bottom surface and a top surface, wherein an electrically conductive wire is wrapped around the base unit. The wire is wrapped in the same direction around the base unit to form a wire coil having substantially parallel windings, and the wire coil is also connectable to an alternating current source. The base unit further includes a central passage extending longitudinally therethrough from the bottom surface to the top surface, wherein the central passage extends in a direction substantially perpendicular to the direction of the wire windings. A cylindrical core extends through the central passage of the base unit and further extends through the top surface and outside of the base unit in the longitudinal direction of said central passage. An armature is positioned a predetermined distance from the top surface of the base unit, with the armature being positioned substantially parallel to the windings of the wire coil. The cylindrical core further extends through the center of the armature. The armature is movable in response to a magnetic force created by the wire coil, wherein the armature may reciprocate along the longitudinal axis of the cylindrical core.

The A.C. relay further includes a first contact board having a plurality of contacts mounted thereon which are connected to external circuits, and a second contact board having a plurality of contacts mounted thereon which are also connected to external circuits. A third movable contact board is positioned between the first and second contact boards, wherein the movable contact board includes a plurality of contacts connected to a plurality of external circuits. The movable contact board allows these external circuits to be connected to the plurality of contacts on either the first contact board or the second contact board. The movable contact board is connected to the armature, so that the third movable contact board moves in conjunction with the movement of the armature. Therefore, the contacts on the movable contact board are switched between the contacts on the first contact board and the contacts on the second contact board in response to the movement of the armature, which moves in response to the magnetic field created by the wire coil.

These as well as additional advantages of the present invention will become apparent from the following description of the invention with reference to the several figures.

DETAILED DESCRIPTION OF THE DRAWINGS

Figure 1:
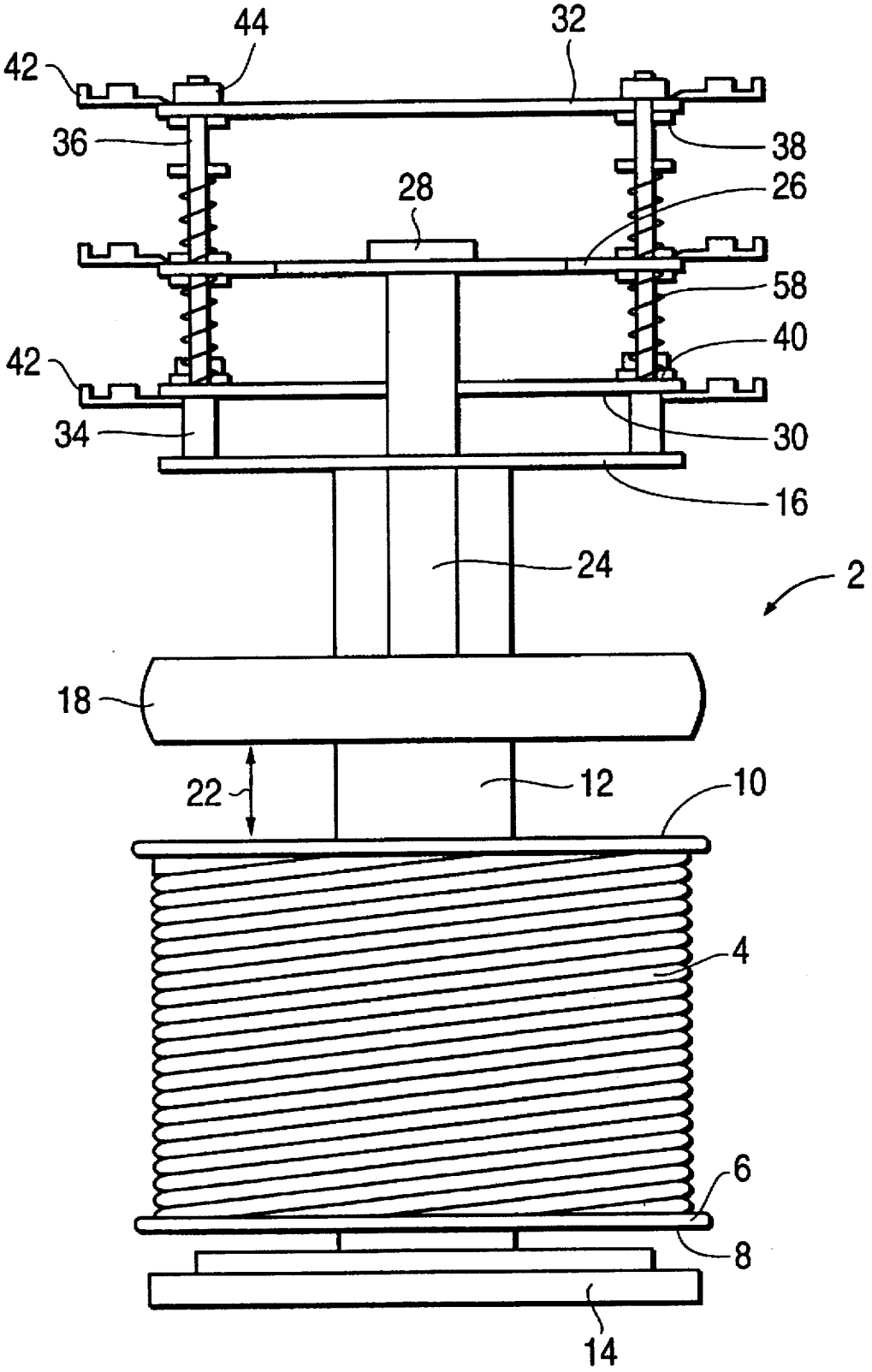
FIG. 1 is a side view of the alternating current relay in accordance with a preferred embodiment of the present invention before the relay is energized.
Figure 2:
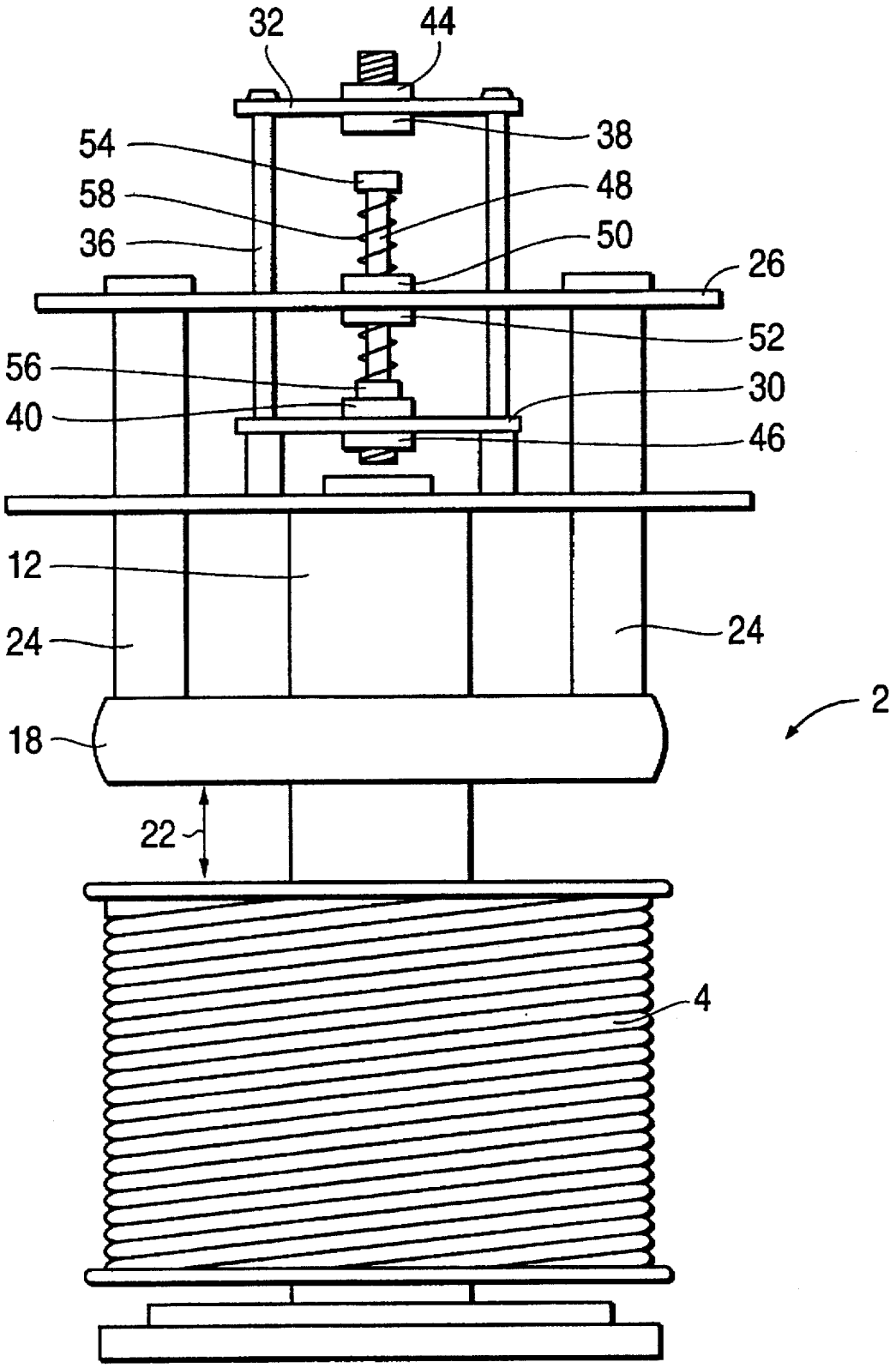
FIG. 2 is a side view of the alternating current relay before the relay is energized in accordance with a preferred embodiment of the present invention rotated 90° from the view illustrated in FIG. 1.

Referring now to FIGS. 1 and 2, side views of the Lenz relay 2 are illustrated in accordance with the present invention for simultaneous switching of a plurality of electrical contacts. The Lenz relay 2 includes a wire coil 4 which is formed by wrapping an electrically conductive wire, such a copper, around a cylindrical base unit 6, wherein the wire is wrapped around the cylindrical base unit 6 is the same direction to form a wire coil 4 having substantially parallel wire windings. The wire coil 4 is connectable to an alternating current, so that the flow of alternating current through the wire coil 4 creates a magnetic field which will be later discussed in greater detail. The cylindrical base unit 6 includes a central passage 7 extending longitudinally therethrough the base unit 6, wherein the central passage 7 extends from the bottom surface 8 of the base unit 6 to the top surface 10. The central passage 7 extends in a direction substantially perpendicular to the direction of the windings of wire coil 4.

Figure 3:
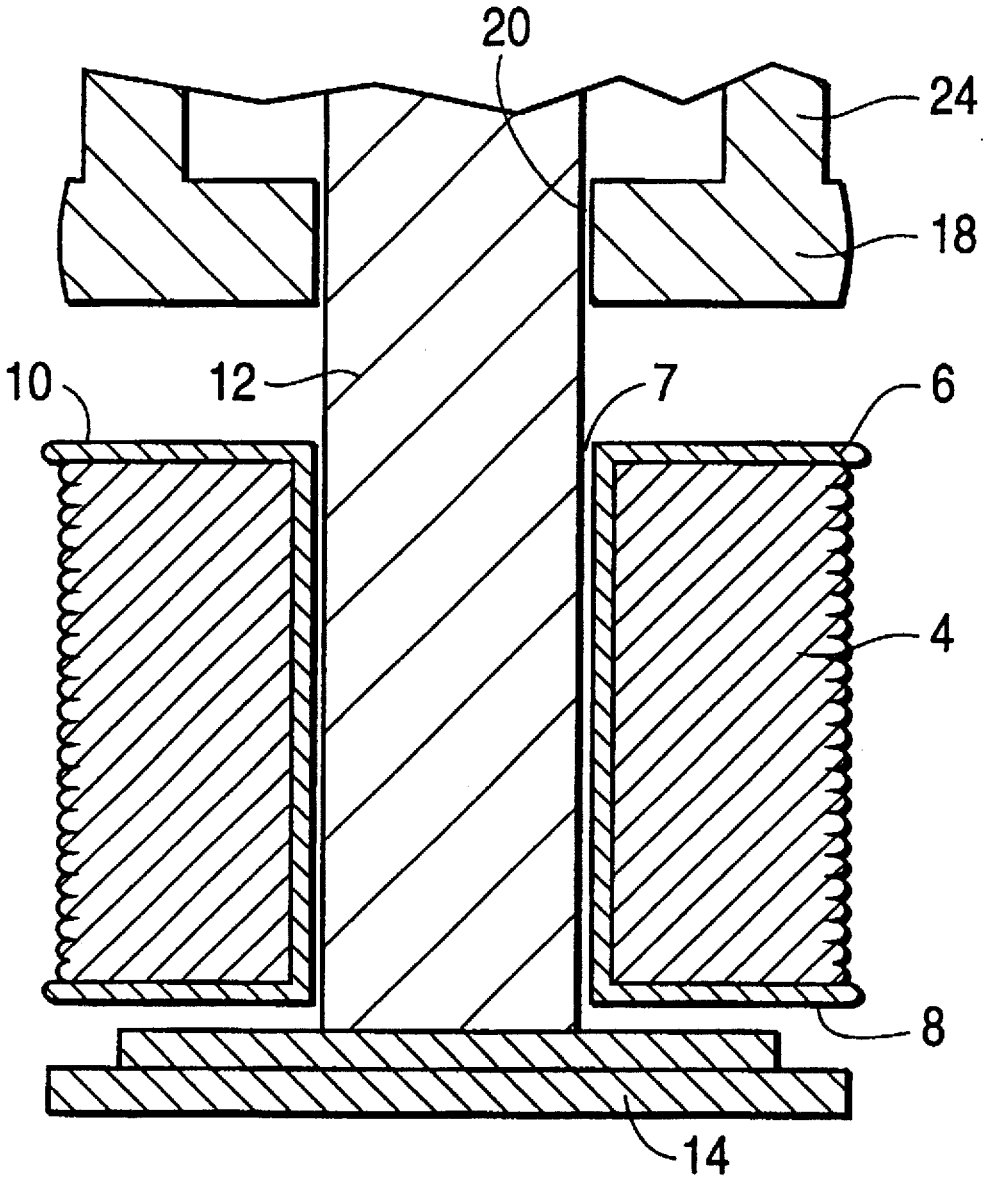
FIG. 3 is a fragmentary sectional view in accordance with a preferred embodiment of the present invention.

A cylindrical core 12 extends through the central passage 7 of the base unit 6 and further extends through the top surface 10 and outside of the base unit 6 in the longitudinal direction of said central passage 7, as shown in the cross-sectional view of the A.C. relay illustrated in FIG. 3. The cylindrical core 12 also extends through the bottom surface 8 of the base unit 6 and connects to a support unit 14 which provides a foundation for the Lenz relay 2 when it is intended to be a free-standing unit. The support unit 14 may also abut the bottom surface 8 of base unit 6 to limit the movement of the base unit 6 along the cylindrical core 12 in the direction of the support unit 14. The diameter of the cylindrical core 12 is only slightly smaller than the diameter of central passage 7 so that the outer surface of the cylindrical core 12 frictionally engages the inner surface of the central passage 7 in order to inhibit the movement of the base unit 6 along cylindrical core 12. Therefore, once the cylindrical core 12 in inserted into the base unit 6, these two components remain stationary with respect to each other during the operation of the Lenz relay 2. This configuration is quite different from most prior art A.C. relays which conventionally have either a core or an armature extending through the center of a wire coil, wherein the core or armature is movable with respect with respect to the wire coil. In the preferred embodiment of the present invention, the cylindrical core 12 remains stationary with respect to the wire coil 4. While the core 12 is described as being cylindrical in accordance with the preferred embodiment of the present invention, it is understood that the core 12 may comprise any shape as long as the central passage 7 in the base unit comprises a similar shape to that of the core 12.

In the preferred embodiment of the present invention, the core 12 is comprised of laminated iron or other similar magnetic material. However, in an alternative embodiment, a non-magnetic material may be used as the core 12 material which does not carry the magnetic force fields created by the wire coil 4. The core 12 extends from the support unit 14, through base unit 6, and continues to mounting plate 16, where the core 12 is affixed to mounting plate 16.

The Lenz relay 2 also includes an armature 18 positioned between the wire coil 4 and mounting plate 16, wherein the armature 18 is in the shape of an annular disc having an aperture 20 extending throughout its center. The core 12 extends through aperture 20 in armature 18 with the aperture 20 having the same general shape as core 12, which is circular in the preferred embodiment. However, the armature 18 does not frictionally engage the core 12 as the base unit 6 does, rather the aperture 20 in the armature 18 fits closely around the core 12 while allowing the armature 18 to be freely reciprocal along the longitudinal direction of the core 12. It is this reciprocating movement of the armature 18 which serves to open and close a plurality of contacts to external circuits, as will hereinafter be discussed in greater detail. The armature 18 is positioned a predetermined distance 22 from the top surface 10 of the wire coil 4, and the armature 18 remains in this position before the wire coil 4 is energized with alternating current. Hence, the armature 18 does not abut the top surface 10 of base unit 6, since the armature 18 will never travel closer to the top surface 10 of base unit 6 than the predetermined distance 22.

The armature 18 is non-magnetic in nature and is preferably made of aluminum or some other non-magnetic metal. The armature 18 further includes a plurality of push rods 24 which extend from the top surface of the armature 18 and are connected to a movable contact board 26. The push rods 24 may be integrally formed with the armature 18 so that they are composed of the same material, or the push rods 24 may be connectable to the armature by threading, welding, or other similar fastening methods. The push rods 24 may be attached to the movable contact board 26 by screwing a nut 28 onto threaded portions at the end of the push rods 24 on both sides of the movable contact board 26, or the push rods may be directly connected to the movable contact board 26. Therefore, the movable contact board 26 moves in conjunction with the reciprocating motion of the armature 18 since contact board 26 and armature 18 are rigidly interconnected by push rods 24. The movable contact board 26 is positioned on the opposite side of mounting plate 16 from armature 18, so that mounting plate 16 includes apertures therein for allowing push rods 24 to travel therethrough to connect to movable contact board 26.

The mounting plate 16 provides the supporting structure for a pair of contact boards 30 and 32. The lower contact board 30 is attached to mounting plate 16 with a plurality of spacers 34 positioned therebetween, where the preferred embodiment of the present invention includes a rectangular contact board 30 having a spacer 34 positioned beneath each corner of the contact board 30. The upper contact board 32 has the same general shape as lower contact board 30, and the upper contact board 32 is connected to lower contact board 30 in a similar manner as the lower contact board 30 is connected to mounting plate 16. A plurality of spacers 36 are also positioned between the upper contact board 32 and the lower contact board 30 to rigidly connect the two contact boards 30 and 32. In one embodiment, the spacers 36 and spacers 34 are axially aligned to accommodate a screw which extends from the upper contact board 32, through the lower contact board 30, through spacer 34, through mounting plate 16 and attached to a nut on the other side of mounting plate 16. In the preferred embodiment, four spacers 36 are positioned beneath the corners of a rectangular upper contact board 32 in axial alignment with spacers 34 beneath lower contact board 30.

Movable contact board 26 is positioned between lower contact board 30 and upper contact board 32, wherein movable contact board 26 is shaped so that it extends between the spacers 36 connecting lower contact board 30 and upper contact board 32. In the preferred embodiment of the present invention, the movable contact board 26 is cross-shaped with each projection of the cross extending between two spacers 36. The contact boards 26, 30 and 32 are preferrably manufactured of an insulating material, such as fiber board or the like.

Each contact board further includes a plurality of electrical contacts connected to circuits external to the Lenz relay 2. Contacts 38 are positioned on the lower surface of upper contact board 32 and contacts 40 are positioned on the upper surface of lower contact board 30. The contacts 38 and 40 may be integrally formed with the contact boards as many of today's circuit boards are manufactured, or, in accordance with the preferred embodiment of the present invention, the contacts 38 and 40 may comprise electrically conductive bolts which extend through the contact board and are attached to the contact board by electrically conductive nuts 44 and 46 on the other side of the contact board. Electrical connectors 42 which connect the electrically conductive nuts and bolts to external circuits are also attached to the nut-bolt assembly by inserting an aperture in the electrical connector 42 around the contact bolts 38 and 40 before screwing nuts 44 and 46 on the bolts 38 and 40. Accordingly, the nuts 44 and 46 securely hold the electrical connectors 42 in place against the contact boards and the electrical connectors 42 are electrically conductive with contacts 38 and 40.

Movable contact board 26 also includes a plurality of electrical contacts connected to circuits external to the Lenz relay 2 through electrical connectors 42. A plurality of electrically conductive rods 48 extend through apertures in the movable contact board 26, wherein rods 48 also extend through nuts 50 and 52 which contain apertures therein. The apertures in nuts 50 and 52 are substantially the same size as the apertures in movable contact board 26. Furthermore, similar to the electrical contacts 38 and 40, the nuts 50 and 52 can be electrically conductive wherein the nuts 50 securely hold the electrical connectors 42 in place against the movable contact board 26. The rods 48 have a diameter slightly smaller than that of the apertures in the movable contact board 26 and nut and bolt assembly, such that the rods 48 are freely reciprocal with respect to movable contact board 26 but closely fit within the apertures so that the rods 48 reciprocate in a stable manner. Electrical contacts 54 are positioned on the top of each rod 48 while contacts 56 are positioned on the bottom of each rod 48, wherein contacts 54 and 56 are electrically connected since rod 48 is electrically conductive. Additionally, since the rod 48 is not rigidly affixed to electrically conductive nut 50, a conductive wire may be run from contact 54 to nut 50 in order to increase the effective conductive circuit between the nut 50 and contacts 54 and 56. Contacts 54 and 56 may be attached to rod 48 in any manner which allows proper electrical conductivity between the contacts and the rod 48, and, in accordance with the preferred embodiment, the contacts 54 and 56 are nuts which are screwed onto threaded portions at the ends of the rod 48.

Springs 58 are also positioned around rod 48 between contact 54 and nut 50 and between contact 56 and nut 52 for absorbing shock as the contact board 26 moves between energized and deenergized states, which is described in detail below. The springs 58 provide balancing for the plurality of movable contacts 54 and 56, and further provide an additional a conductive path for electricity flowing from the contacts 54 and 56 to the electrical connections 42 through nuts 50 and 52.

The contacts 54 and 56 are axially aligned with contacts 38 and 40 along the longitudinal direction of the rods 48. Additionally, the rods 48 are shorter in length than the distance between contacts 38 and 40 so that the contacts 54 and 56 on rods 48 cannot come into contact with the contacts 38 on upper contact board 32 and contacts 40 on lower contact board 30 at the same time. When the wire coil 4 is in a deenergized state, contact 56 on the lower end of each rod 48 abuts its axially aligned contact 40 on the lower contact board 30. Thus, when the A.C. relay is a deenergized state, the external circuits attached to the electrical connectors 42 on the movable contact board 26 and the external circuits attached to the electrical connectors 42 on the lower contact board 30 are electrically interconnected. This electrical interconnection flows as follows: external circuits are connected to the electrical connectors 42 on the lower contact board 30; the electrical connectors 42 are electrically connected to nut 46 and contact 40; contact 40 forms an electrical path with contact 56 when the two are abutting; an electrical path exists between contact 56 and rod 48; rod 48 is attached to contact 54 and also partially contacts conductive nut 50; contact 54 is further connected to conductive nut 50 through an electrical wire; conductive nut 50 abuts electrical connector 42 so that an electrical path exists between the two components; and electrical connectors 42 on movable contact board 26 are attached to external circuits.

Since armature 18 is freely reciprocal about core 12 and is also connected to movable contact board 26 through push rods 24, movable contact board 26 has the same reciprocating motion as armature 18. The motion of movable contact board 26 in the downward direction is limited by the compressed spring 58 between nut 52 and contact 56 when the contact 56 on the rod 48 abuts contact 40 on lower contact board 30. As the motion of movable contact board 26 is limited by the above configuration, the movement of armature 18 in the downward direction is also limited. Therefore, when contact 56 abuts contact 40 the movable contact board 26 and, in turn, armature 18 have reached their further point of travel in the downward direction, which is the predetermined distance 22 between armature 18 and the top surface 10 of base 6. The armature 18 remains at this lowest point of travel when the A.C. relay is in a deenergized state. In the deenergized state, when contact 56 is abutting contact 40, there is an air gap, and thus no electrical connection, between contact 54 and contact 38 on the upper contact board 32.

Figure 4:
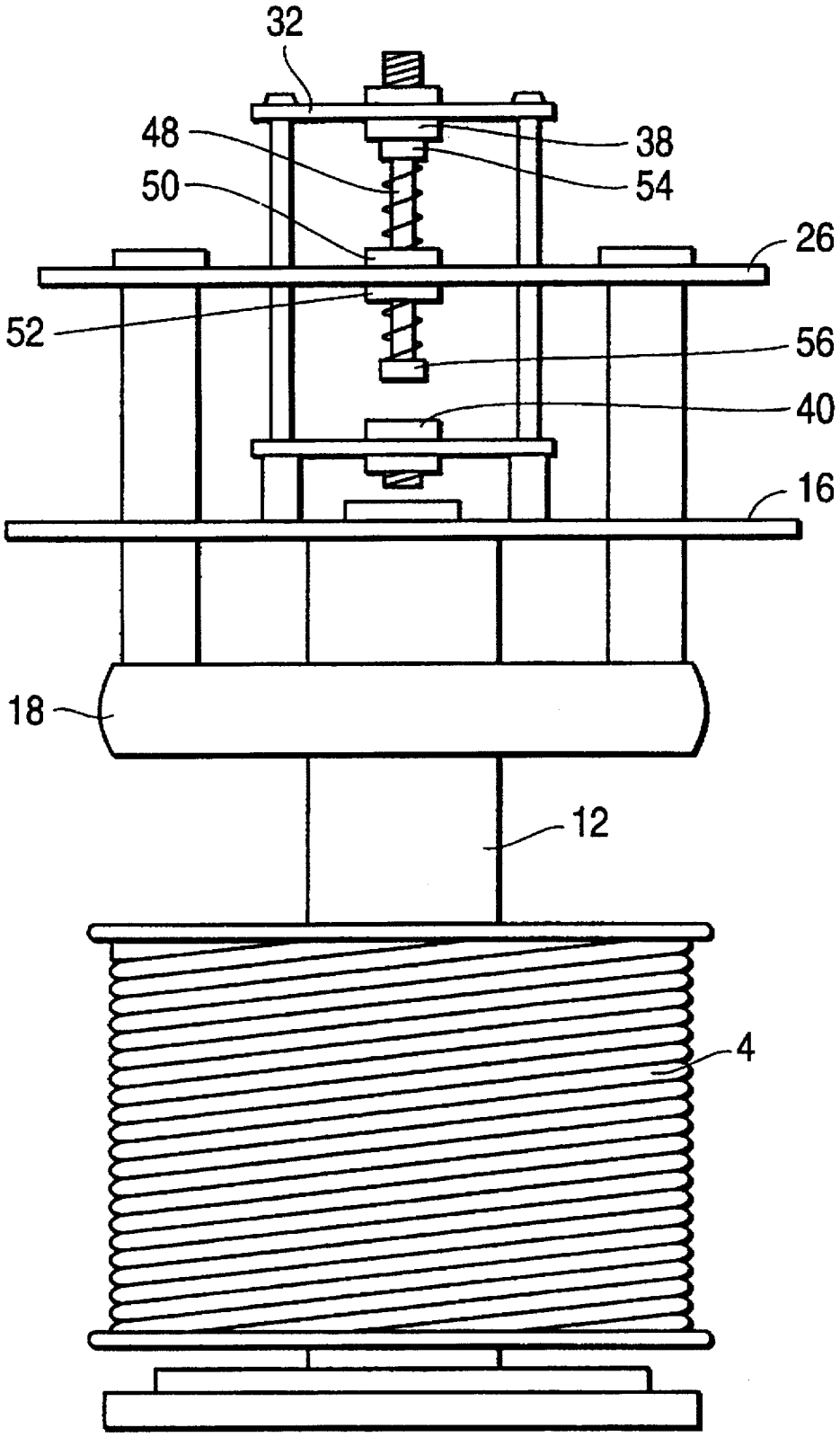
FIG. 4 is a side view of the alternating current relay after the relay is energized in accordance with a preferred embodiment of the present invention rotated 90° from the view illustrated in FIG. 1.

Referring now to FIG. 4, when an alternating current is applied to the wire coil 4 and the A.C. relay is in an energized state, the armature 18 is forced in an upward direction, as will hereinafter be discussed in greater detail, which in turn forces movable contact board 26 in an upward direction. This upward movement of contact board 26 breaks the electrical connection between contact 56 and contact 40, and contact board 26 continues in an upward motion until contact 54 on rod 48 abuts contact 38. Similar to the movement in the downward direction, the motion of movable contact board 26 in the upward direction is limited by the compressed spring 58 between nut 50 and contact 54 when the contact 54 on the rod 48 abuts contact 38 on upper contact board 32. As the motion of movable contact board 26 is limited by the above configuration, the movement of armature 18 in the upward direction is similarly limited.

Therefore, when contact 54 abuts contact 38 the movable contact board 26 and, in turn, armature 18 have reached their further point of travel in the upward direction. The armature 18 remains at this farthest point of travel in the upward direction when the A.C. relay is in an energized state. In the energized state, when contact 54 is abutting contact 38, there is an air gap, and thus no electrical connection, between contact 56 and contact 40 on the lower contact board 30.

Operation of the A.C. Relay

When the Lenz relay 2 is in a deenergized state, the armature 18 is situated a distance 22 from the top surface 10 of the base unit 6 and the bottom contacts 56 on rods 48 are abutting the contacts 40 on lower contact board 30. The Lenz relay 2 is energized by applying an alternating current to the wire coil 4, wherein the flow of current through the wire coil 4 generates a magnetic field in the wire coil 4. This resulting magnetic field then forces the non-magnetic, annular armature 18 away from the wire coil 4, thus increasing the distance between the armature 18 and the top surface 10 of base unit 6. The moving armature 18 forces the push rods 24 and, in turn, movable contact board 26 in the same direction away from wire coil 4. This upward motion of movable contact board 26 changes the circuit between contacts 56 and 40 from normally closed contacts to open contacts. The upward motion of movable contact board 26 is stopped when the contact 54 on the top of the rods 48 abuts the contact 38 on the upper contact board 32. Therefore, this upward motion of movable contact board 26 changes the circuit between contacts 54 and 38 from normally open contacts to closed contacts. Accordingly, by energizing the Lenz relay 2, a plurality of contacts connected to external circuits may be switched to a different set of external circuits, wherein any fixed number of contacts may be used to control any fixed number of external circuits. This configuration allows all of the external circuits to be switched simultaneously.

Once the flow of alternating current through wire coil 4 is stopped, the magnetic field generated in the wire coil also ceases. With no magnetic field forcing the armature 18 in a direction away from the wire coil 4, the armature 18 will return to its deenergized position, the predetermined distance 22 from the top surface 10 of base unit 6. With the armature 18 moving in a direction toward wire coil 4, the movable contact board 26 also moves in the same direction thus changing the circuit between contacts 54 and 38 from closed contacts to normally open contacts and changing the circuit between contacts 56 and 40 from open contacts to normally closed contacts. In an alternative embodiment to the present invention, a latching device may be utilized between contact 54 and contact 38 so that the circuit between contacts 54 and 38 remain closed after the A.C. relay is deenergized. Therefore, the latching device would prevent the movable contact board 26 from moving in a direction toward lower contact board 30. The latching device could thereby be utilized to save electricity since the circuit between contacts 54 and 38 would remain closed without the need to keep the Lenz relay 2 energized. The latching device could then be released by either electrical or mechanical methods. The latching device may comprise a mechanical latch which holds contacts 54 and 38 together, or either of the contacts 54 and 38 may be magnetized to attract the other contact once they abut each other.

The Lenz relay 2 in accordance with the present invention differs from conventional A.C. relays in that the armature 18 is comprised of a non-magnetic material and the armature 18 is not positioned within the wire coil 4. It is believed that the non-magnetic armature 18 is movable in response to the magnetic field generated by the wire coil 4 in accordance with the principles associated with Lenz's law, which states that the current in a conductor as a result of an induced voltage is such that the change in magnetic flux due to the current is opposite to the change in flux that caused the induced voltage. Therefore, the alternating current flowing through the wire coil 4 generates a time-varying magnetic field in the wire coil 4. This time-varying magnetic field produces an electromotive force, which establishes a current in suitable closed circuits, such as the annular armature 18. The currents induced in armature 18 are eddy currents which act to produce an opposing time-varying magnetic field in the armature 18 to the magnetic field generated by wire coil 4. Accordingly, since the armature 18 has a resulting magnetic field opposite to the magnetic field generated by wire coil 4, armature 18 will be forced in a direction away from wire coil 4 while the Lenz relay 2 is energized. Therefore, the predetermined distance 22 between armature 18 and the top surface 10 of base unit 6 must be such that magnetic field generated by wire coil 4 will act on armature 18 to induce the eddy currents therein.

Figure 5:
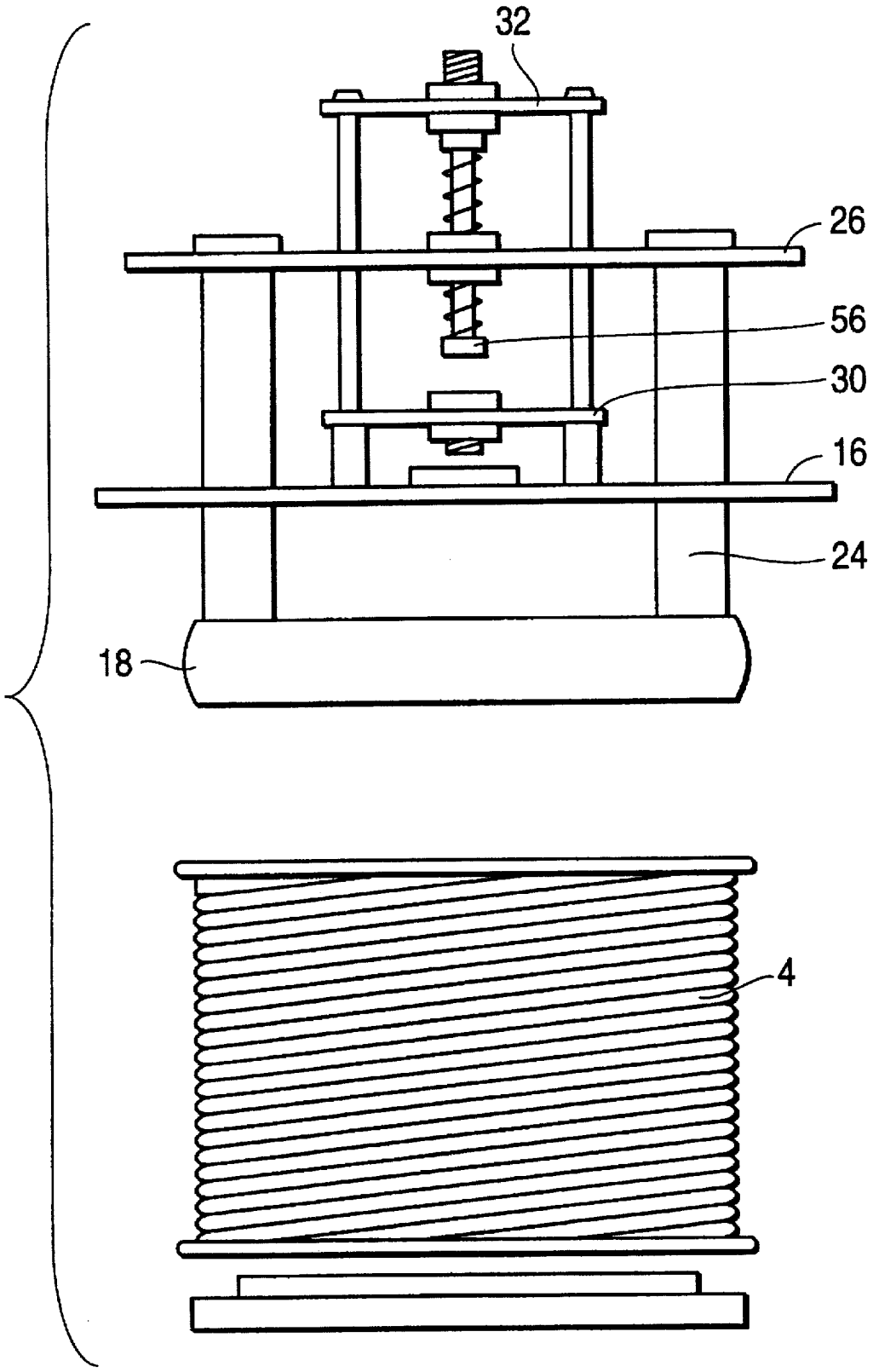
FIG. 5 is a side view of an alternative embodiment of the present invention.

In accordance with operation of the Lenz relay 2 as described above, the relay may function equally as well without having a core at all since the magnetic field generated by the wire coil 4 is what forces the armature 18 away from the wire coil 4. Therefore, an alternative embodiment to the present invention, as illustrated in FIG. 5, includes a Lenz relay 2 which does not have a core element 12, wherein the base unit 6 would not be physically connected to mounting plate 16. While the armature 18 would still be positioned in the same manner with respect to wire coil 4, it would be freely movable free of support from any element extending from base unit 6. Instead, the armature 18 would be stabilized by having the push rods 24 reciprocate within the apertures in mounting plate 16 while closely fitting within the apertures.

As can be seen by the foregoing, an A.C. relay formed in accordance with the present invention will provide an improved method for simultaneously switching a plurality of electrical contacts. Moreover, by forming an A.C. relay in accordance with the present invention, an A.C. relay is provided which does not require the use of a laminated magnetic core or an armature comprised of a magnetic material.

While the present invention has been described with reference to a preferred embodiment, it should be appreciated by those skilled in the art that the invention may be practiced otherwise than as specifically described herein without departing from the spirit and scope of the invention. It is, therefore, to be understood that the spirit and scope of the invention be limited only by the appended claims.

What is claimed is:

1. A relay which is energized by an alternating current for switching a plurality of electrical contacts comprising:

a cylindrical base unit having a bottom surface and a top surface;

an electrically conductive wire wrapped around said base unit; said wire being wrapped in the same direction around the base unit to form a wire coil having substantially parallel windings;

said wire coil being connectable to an alternating current;

said base unit including a central passage extending longitudinally therethrough from said bottom surface to said top surface; said central passage extending in a direction substantially perpendicular to the direction of said wire windings;

a cylindrical core extending through said central passage of said base unit and further extending through said top surface outside of said base unit in the longitudinal direction of said central passage;

armature means positioned proximate to said top surface of said base unit; said armature means being substantially parallel to the windings of said wire coil; said cylindrical core further extending through said armature means;

said armature means being movable along the longitudinal axis of said cylindrical core by a magnetic field created by said wire coil; and contact means connected to said armature means for switching external circuit contacts attached to said contact means between open and closed positions.

2. The relay as defined in claim 1, wherein said contact means comprises:

a first contact board having a plurality of contacts mounted thereon which may be connected to external circuits;

a second contact board having a plurality of contacts mounted thereon which may be connected to external circuits;

connecting means for connecting a plurality of external circuits to the plurality of contacts on either said first contact board or said second contact board; and switching means attached to said armature means for switching the external circuit contacts of said connecting means between the contacts on said first contact board and the contacts on said second contact board; said switching means being movable in response to the movement of said armature means.

3. The relay as defined in claim 1, wherein said cylindrical core comprises a laminated iron core.

4. The relay as defined in claim 1, wherein said cylindrical core is comprised substantially of a non-magnetic material.

5. The relay as defined in claim 1, wherein said armature means is comprised substantially of a non-magnetic electrically-conductive material.

6. The relay as defined in claim 5, wherein said non-magnetic electrically-conductive material is a metal.

7. The relay as defined in claim 6, wherein said metal is aluminum.

8. The relay as defined in claim 1, wherein said armature means and said connecting means are connected together by at least one push rod.

9. The relay as defined in claim 2, wherein said switching means is positioned between said first contact board and said second contact board.

10. The relay as defined in claim 1, wherein said contact boards are comprised substantially of an insulating material.

11. A relay which is energized by an alternating current for switching a plurality of electrical contacts comprising:

a cylindrical base unit having a bottom surface and a top surface;

an electrically conductive wire wrapped around said base unit; said wire being wrapped in substantially the same direction around the base unit to form a wire coil having substantially parallel windings;

said wire coil being connectable to an alternating current;

said base unit including a central passage extending longitudinally therethrough from said bottom surface to said top surface; said central passage extending in a direction substantially perpendicular to the direction of said wire windings;

a cylindrical core extending through said central passage of said base unit and further extending through said top surface outside of said base unit in the longitudinal direction of said central passage;

armature means positioned proximate to said top surface of said base unit; said armature means being substantially parallel to the windings of said wire coil; said cylindrical core further extending through said armature means;

said armature means being movable along the longitudinal axis of said cylindrical core by a magnetic field created by said wire coil;

said armature means being comprised substantially of a non-magnetic electrically-conductive material; and contact means connected to said armature means for switching external circuit contacts attached to said contact means between open and closed positions.

12. The relay as defined in claim 11, wherein said non-magnetic electrically-conductive material is a metal.

13. The relay as defined in claim 12, wherein said metal is aluminum.

14. The relay as defined in claim 11, wherein said contact means comprises:

a first contact board having a plurality of contacts mounted thereon which may be connected to external circuits;

a second contact board having a plurality of contacts mounted thereon which may be connected to external circuits;

connecting means for connecting a plurality of external circuits to the plurality of contacts on either said first contact board or said second contact board; and switching means attached to said armature means for switching the external circuit contacts of said connecting means between the contacts on said first contact board and the contacts on said second contact board; said switching means being movable in response to the movement of said armature means.

15. The relay as defined in claim 14, wherein said switching means is positioned between said first contact board and said second contact board.

16. The relay as defined in claim 11, wherein said cylindrical core comprises a laminated iron core.

17. The relay as defined in claim 11, wherein said cylindrical core is comprised substantially of a non-magnetic material.

18. The relay as defined in claim 11, wherein said armature means and said connecting means are connected together by at least one push rod.

19. The relay as defined in claim 14, wherein said contact boards are comprised substantially of an insulating material.

20. A alternating current relay for switching a plurality of electrical contacts comprising:

a wire coil having substantially parallel wire windings;

said wire coil being connectable to an alternating current; said wire coil further being free from having a magnetic material extending through the center of the wire coil;

armature means positioned proximate to a top surface of said wire coil; said armature means being substantially parallel to the windings of said wire coil;

said armature means being movable by a magnetic field generated by said wire coil in a direction perpendicular to windings of the wire coil; and contact means connected to said armature means for switching external circuit contacts attached to said contact means between open and closed positions.

21. The relay as defined in claim 20, wherein said contact means comprises:

a first contact board having a plurality of contacts mounted thereon which may be connected to external circuits;

a second contact board having a plurality of contacts mounted thereon which may be connected to external circuits;

connecting means for connecting a plurality of external circuits to the plurality of contacts on either said first contact board or said second contact board; and switching means attached to said armature means for switching the external circuit contacts of said connecting means between the contacts on said first contact board and the contacts on said second contact board; said switching means being movable in response to the movement of said armature means.

22. The relay as defined in claim 21, wherein said switching means is positioned between said first contact board and said second contact board.

23. The relay as defined in claim 20, wherein said cylindrical core comprises a laminated iron core.

24. The relay as defined in claim 20, wherein said cylindrical core is comprised substantially of a non-magnetic material.

25. The relay as defined in claim 20, wherein said armature means is comprised substantially of a non-magnetic electrically-conductive material.

26. The relay as defined in claim 25, wherein said non-magnetic electrically-conductive material is a metal.

27. The relay as defined in claim 26, wherein said metal is aluminum.

28. The relay as defined in claim 21, wherein said contact boards are comprised substantially of an insulating material.

29. A alternating current relay for switching a plurality of electrical contacts comprising:

a stationary wire coil having substantially parallel wire windings;

said wire coil being connectable to an alternating current; said wire coil further being free from having a magnetic material extending through the center of the wire coil;

armature means positioned a predetermined distance from a top surface of said wire coil; said armature means being substantially parallel to the windings of said wire coil; said armature means being comprised substantially of a non-magnetic electrically-conductive material;

said armature means being movable by a magnetic field generated by said wire coil in a direction perpendicular to windings of the wire coil; and contact means connected to said armature means for switching external circuit contacts attached to said contact means between open and closed positions;

wherein said wire coil and said armature means are free from containing any normally magnetic materials.

30. The relay as defined in claim 29, wherein said armature means is free from physical attachment to said wire coil.

* * * * *